US005452664A

United States Patent [19]

Richmond

[11] Patent Number: 5,452,664

[45] Date of Patent: Sep. 26, 1995

[54] ARTICULATED, LOW LEVEL RAILROAD SPINE CAR WITH OVERLAPPING KINGPIN CONNECTORS

[75] Inventor: Shaun Richmond, Orland Park, Ill.

[73] Assignee: Thrall Car Manufacturing Company, Chicago Heights, Ill.

[21] Appl. No.: 188,524

[22] Filed: Jan. 28, 1994

[51] Int. Cl.[6] ..... B61D 17/00

[52] U.S. Cl. ..... 105/4.1; 410/54; 410/56

[58] Field of Search ..... 105/4.1, 355; 410/54, 410/56, 58, 64, 68

[56] References Cited

U.S. PATENT DOCUMENTS

| | | | |
|---|---|---|---|
| 3,357,371 | 12/1967 | Gutridge | 105/366 |
| 3,399,631 | 9/1968 | Weber | 105/4.1 |
| 3,568,607 | 3/1971 | Gutridge | 410/54 |
| 4,233,909 | 11/1980 | Adams et al. | 105/4.1 |
| 4,524,699 | 6/1985 | Pavlick | 105/4.1 |
| 4,636,119 | 1/1987 | Terlecky | 410/54 |
| 4,681,040 | 7/1987 | Brodeur et al. | 105/3 |
| 4,686,907 | 8/1987 | Woollam et al. | 105/4.1 |
| 4,750,431 | 6/1988 | Yates et al. | 105/4.1 |
| 4,751,882 | 6/1988 | Wheatley et al. | 105/416 X |
| 4,775,035 | 10/1988 | Brodeur et al. | 188/195 |
| 4,826,371 | 5/1989 | Brown | 410/54 |
| 4,854,791 | 8/1989 | Brown | 410/52 |
| 4,867,622 | 9/1989 | Brown | 410/54 |
| 4,917,019 | 4/1990 | Hesch et al. | 105/4.1 |
| 4,929,132 | 3/1990 | Yeates et al. | 410/56 |
| 4,947,760 | 8/1990 | Dawson et al. | 105/3 |
| 5,052,868 | 10/1991 | Hesch et al. | 410/54 |

OTHER PUBLICATIONS

Thrall Car Manufacturing Company specification sheet entitled "Articulated All-Purpose Flat Car," undated.

*Primary Examiner*—Robert J. Oberleitner
*Assistant Examiner*—S. Joseph Morano
*Attorney, Agent, or Firm*—Fitch, Even, Tabin & Flannery

[57] ABSTRACT

An articulated railroad car for carrying container or trailer loads providing for improved weight distribution among all the trucks, comprising a forward end car unit, a rearward end car unit, a plurality of interior car units substantially linearly and adjacently disposed between the forward and rearward car units. Between each adjacent pair of car units, the car has a shared truck having axles for supporting one end of one car unit and one end of the other car unit. A central shared truck is centrally located along the length of the railroad car. Articulated connectors on the shared trucks join the interior car units to one another and to the end car units, and a hitch for a kingpin on each of the car units is placed over the truck associated with the car unit which is farther from the central truck, to facilitate relatively even load distribution among all the trucks.

8 Claims, 2 Drawing Sheets

ARTICULATED, LOW LEVEL RAILROAD SPINE CAR WITH OVERLAPPING KINGPIN CONNECTORS

BACKGROUND OF THE INVENTION

This invention relates to articulated railroad cars having a plurality of car units articulated to one another and used for transporting truck trailers or containers.

The present invention relates to so-called articulated "spine" car units which have minimum structure such as a central beam or spine, and which are constructed with end car units having standard trucks and standard couplers for coupling with other cars in a train makeup, and which have interior car units sharing a common truck with adjacent, end car units.. An articulated connector is mounted on each shared truck to provide an articulated movement between adjacent car units as the car travels about a curve. Typically, such an articulated railroad car has five car units with three interior car units and four shared trucks; and the car units may be readily converted to support either truck trailers or containers, as disclosed in U.S. Pat. Nos. 5,052,868 and 4,233,909.

In some countries, for example, European countries, these articulated cars have not met with the widespread success that they enjoy in countries such as the United States. It is thought that one reason for this lack of success is that these articulated cars often would have axle weight loads on a shared truck in excess of the per axle weight load limit, e.g., an axle load limit of 22.5 metric tonnes in a typical European country. In the United States, the axle weight load limit for a shared truck is a higher limit of 39 metric tonnes per axle, because of the stronger road beds in the United States.

In the United States, a well car is often used to transport containers with two containers being stacked one on the other. The well car has a deep well positioned intermediate the trucks at the ends of the car and positioned downwards, significantly below the top of the trucks. Even with this depressed well, in some instances, and very often in countries outside the United States and particularly in Europe, tunnels do not have height to provide clearance for a second, upper stacked container; and only a single container can be placed in the well car. In such instances, the well cars lose one-half of their efficiency in handling freight. In the conventional spine, flat cars, truck trailers also may sit too high, for example, about 16 feet from the tracks, and this is over the thirteen to fourteen foot height limit to have the proper clearance to pass through many tunnels in Europe and other countries although they will operate in the United States.

From an expense standpoint, the articulated car has fewer trucks in that the interior car units share a common truck, and the interior car units lack the expensive semi-automatic couplers or cushioning devices that are only provided for the end car units. The spine cars also have a minimal amount of parts compared to conventional flat cars making them lightweight as well as less expensive. Despite these cost advantages, the spine car has not been widely adopted in Europe because it is thought the height limitation precludes carrying of trailers, and that the carrying of trailers will result in excessive loads on the axles of the interior car units.

SUMMARY OF THE INVENTION

In accordance with the present invention, an articulated car is constructed to carry truck trailers at a low height level and to position the trailers to distribute the load more evenly on the truck axles so as not to exceed the per axle weight loads of 22.5 metric tonnes per axle. To this end, the articulated car is formed with car units having depressions in the sill or beam to lower the position of wheel axles; and the truck trailer hitches are positioned to distribute the weight more evenly over the shared axles and also over the end car truck axles, at least one of which is heretofore usually lightly loaded.

In the preferred embodiment of the invention, the forward end car unit and the rearward end car unit each have a trailer hitch located over their respective end trucks so that more load is placed on these end trucks than in the conventional spine car. Also, the rear trailer wheels are mounted in depressions in the end car units with the truck trailers facing in opposite directions. Also, the preferred car has four or six car units, rather than the conventional three or five car units, with the car units being symmetrically arranged about the midpoint of a central shared truck. The above-described arrangement results in one-half of the trailer trucks facing forwardly and the other half of the trailer trucks facing rearwardly. The center two interior car units have their depressions closely adjacent each other so that the trailer trucks have their rear portions adjacent to and facing one another.

The trailer hitches for the interior car units are mounted to project over the trailing end of the adjacent, end car unit so that more weight can be distributed onto the shared truck between the interior unit and an end car unit. The preferred construction employs an adjustable trailer hitch that can be adjusted for different lengths of trailers to position the trailer hitch at locations immediately adjacent, over or forward of the articulated connection carried on the shared truck.

The result is a more even trailer weight load per axle and a reduction in the number of axles per truck or container, as compared to a well car. With the present invention, there may be only five trucks having ten axles for four trailers in contrast to the well car that will have eight trucks and sixteen axles to transport the same four trailers. Because the trucks are expensive, the reduction in the number of trucks results in a significant cost savings to car purchasers. The present invention also results in a shorter, articulated car length from the length of a train of well cars carrying the same number of trailers or conventional spine cars carrying the same number of trailers. The reduction in car length is important also from the standpoint that sidings may only take a limited train length, and that more trailers may be positioned on the same siding using the present invention than using conventional train cars.

DETAILED DESCRIPTION OF THE PREFERRED EMBODIMENT

Figure 1:
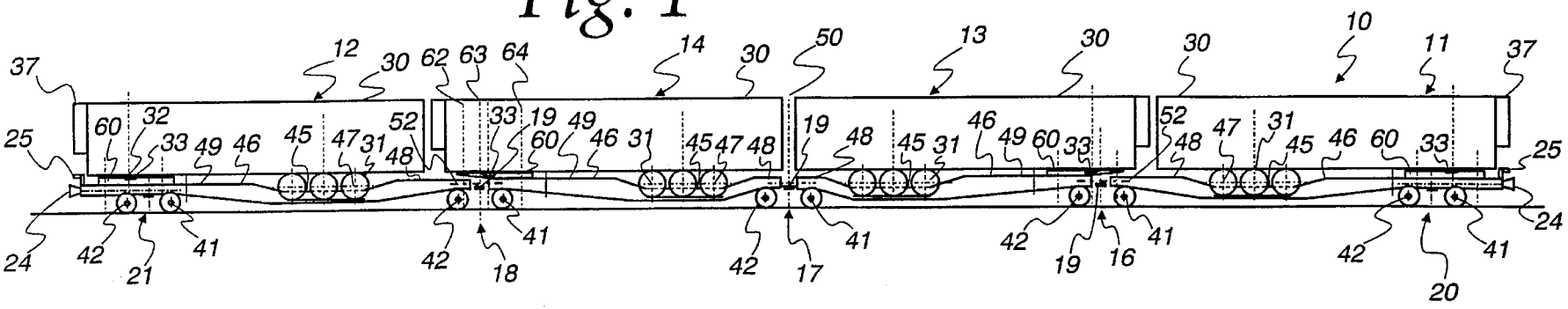
FIG. 1 is a diagrammatic, side elevational view of an articulated car having four car units constructed and arranged in accordance with the present invention.

The invention is embodied in a railroad car often called an articulated or spine car 10, in that there are a number of car units which are articulated together with end car units 11 and 12 being articulated to interior car units 13 and 14 by common, shared trucks 6, 17 and 18. The shared trucks each carry an articulation or connector 19 usually having male or female connecting parts to allow the pivoting of the car units relative to one another when going about curves or the like. Each of the end car units has an end car truck 20 and 21 as well as having a semi-automatic coupler 24 and a suitable cushioning device 25 which allow the entire car to be coupled or decoupled from a train makeup.

Figure 4:
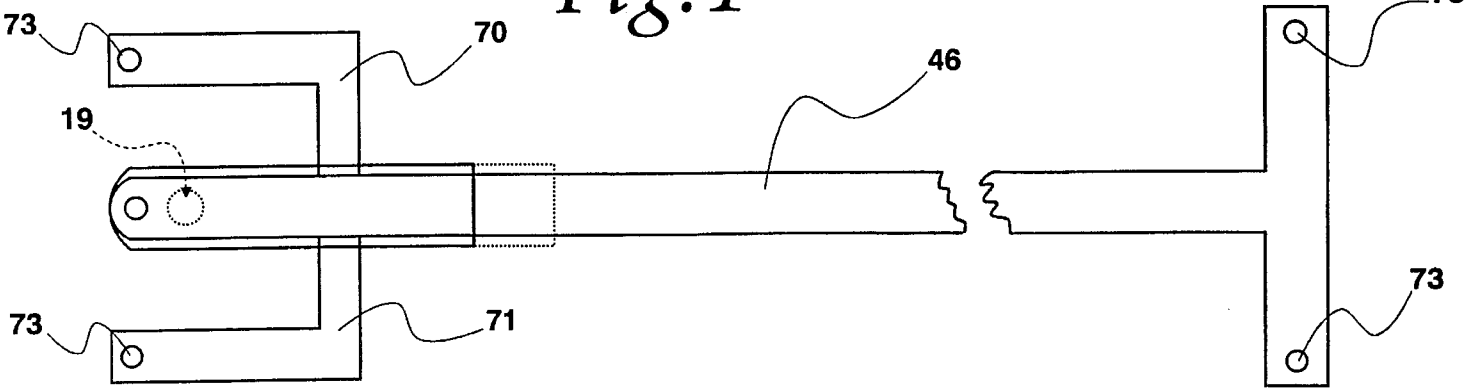
FIG. 4 is a fragmentary, enlarged plan view of arms to carry the corners of a container on a car unit of the car of FIG. 1.

The illustrated car 10 shown in FIG. 1 is to be used to carry either containers or to carry truck trailers 30, which have wheels 31 and a kingpin 32 at the opposite end from the wheels. The kingpin is usually mounted in a known and conventional manner to a hitch 33 which secures and bears the weight of the forward end of the trailer; while the weight at the rear end of the trailer is transmitted through the wheels to the car unit on which the truck rests. It is to be understood that the present invention may be used not only to carry trailers but also conventional containers, as will be described hereinafter in connection with a later embodiment of the invention which is illustrated in FIG. 4.

Figure 2:
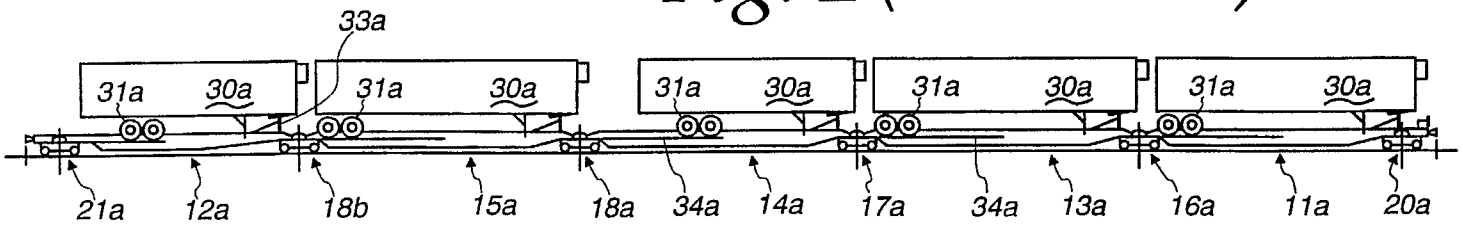
Fig. 2 (Prior Art)
FIG. 2 is a diagrammatic, side elevational view of a prior art articulated car.
Figure 3:
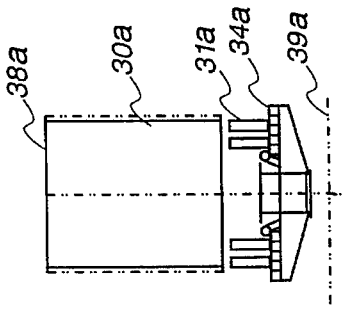
Fig. 3 (Prior Art)
FIG. 3 is a diagrammatic enlarged front elevational view of a trailer mounted on a car unit of the car of FIG. 2.

A conventional spine car of the prior art is shown in FIG. 2, and includes five car units including a forward end car unit 11*a* and a rearward car unit 12*a*, along with three interior car units 13*a*, 14*a* and 15*a*, making for a five-unit car. The five-unit car has shared trucks 16*a*, 17*a*, 18*a* and 18*b*, as shown in FIG. 2, and also has end car trucks 20*a* and 21*a*. In this typical articulated car of FIG. 2, the height of the trailer top wall 38*a* (FIG. 3) above the rails 39*a* is about 16' 1 /½" for a trailer mounted thereon, as shown in FIG. 3 with the trailer wheels 31*a* resting on a platform 34*a*, as shown in FIGS. 2 and 3. The trailer kingpin 32*a* is connected to a trailer hitch 33*a* at a height usually of 36 to 48 inches above the height of the shared trucks and the end trucks. While the illustrated prior art construction of FIG. 2 is generally acceptable in the United States, it has not found widespread use in other countries where the axle load limit is smaller, for example, 22.5 metric tonnes. As can be understood from referring to FIG. 2, the axle loading at the rear axle 42 of the truck 21*a* of the rear unit 12*a* is very light indeed as contrasted to load on the axles of the shared trucks 16*a*, 17*a* and 18*b*. The axle load at the interior shared truck 18*a* (FIG. 2) is relatively light because of the positioning of the trailer wheels which would apply more weight to the axles of the shared truck 17*a*. It is this application of the heavier loads at some of the shared truck axles such as the axles of truck 18*b* that results in axle loads that are too heavy, i.e., above 22.5 metric tonnes. Where the conventional 16' ½" is much too high for the clearance in a number of countries where the truck height on the spine car must be 15' or less, for example, 4.8 meters is a maximum is Europe.

A train of well cars (not shown) is often used in the United States and occasionally in other places, and comprises a series of articulated well car each of which has a deep well between a pair of twin axle trucks to receive a first, lower container, which is positioned down in the well; and then a second, upper container which is stacked on the lower container in the well. The double containers work well so long as there are no particular height restrictions, but the double containers will not meet the height requirement where there is a 4.8 meter maximum height to go through a tunnel or the like. If a truck trailer is positioned in a well, it may be positioned low enough so that it can pass the 4.8 meter height limit. The well cars are provided with a separate truck at each end of the car so that there are no shared trucks as in the spine car. Because there are twin axle trucks at each end of the well car, there are four axles which are supporting the two containers so that the container load per axle is relatively light and may be kept below the 22.5 metric tonnes limit.

However, with the removal of the upper containers because of height limitations, the loads on the well car axles become light; and there is a large reduction in the volume of freight that is being handled per length of train. Additionally, each of the well cars has its own semi-automatic coupler and each well car has its own cushioning device and a pair of expensive twin axle trucks making it an expensive construction relative to the spine car. Further, most of the well cars have a beam which extends longitudinally along the side of the car and is located at the platform height where the passenger would enter a passenger car; and in some instances, there are clearance problems between this beam and the passenger platform.

In accordance with the present invention, there is provided a new and improved articulated car 10, as shown in FIG. 1, in which the load limit may be kept below the 22.5 metric tonnes per truck axle 41 and 42 by placing the trailers 30 on the car units such that the trailer loads are shifted more onto the end trucks 11 and 12, and by shifting the weight forwardly onto the shared trucks 16 and 18, and by having the car be symmetrical about a central midpoint 50 through a centrally located articulation 19, which is between the second and third car units 13 and 14 in FIG. 1.

As shown in FIG. 1, the trailer hitches 33 for the first trailer and for the last trailer are positioned over the end trucks 20 and 21. The first hitch for the first trailer is preferably positioned adjacent the front wheel axle 41 of the front truck 20 and the hitch for the last trailer is preferably positioned over the rear axle 42 of the rear truck 21 with the refrigeration unit 37 of the trailer extending over the axle 42 as far as possible so long as it does not interfere with the coupling or decoupling, and does not interfere with the coupling of the articulated car 10 to other cars in a train. The positioning of the trailer kingpins 32 over and adjacent the respective wheel axles 41 and 42 of the end car trucks 20 and 21, results in a significant shifting of the load onto these end trucks relative to the conventional loading of the trucks, as illustrated in FIG. 2. More specifically as shown in FIG. 2, the rearward wheels 31*a* of the rear trailer are disposed at somewhat of a distance from the rear truck axle 42 of the truck 21*a* and, as a result, the truck axle 42*a* is very lightly loaded.

Also, in accordance with the present invention, the articulated car 10 shown in FIG. 1, is able to carry trailers at a reduced height from the conventional sixteen feet described in connection with the spine cars of FIGS. 2 and 3, and so that the railroad car may be used to carry freight trailers without exceeding a height limit of 4.17 meters. This is achieved in the present invention by providing a depression 45 in center sills 46 so that the wheel axles 47 may be lowered downwardly below the level of an upper, front sill portion 48 and below the level of an upper, rear sill portion 49. Each of these higher front sill portions 48 and the rear sill portions 49 are disposed above the trucks which support the same, as shown in FIG. 1.

Figure 5:
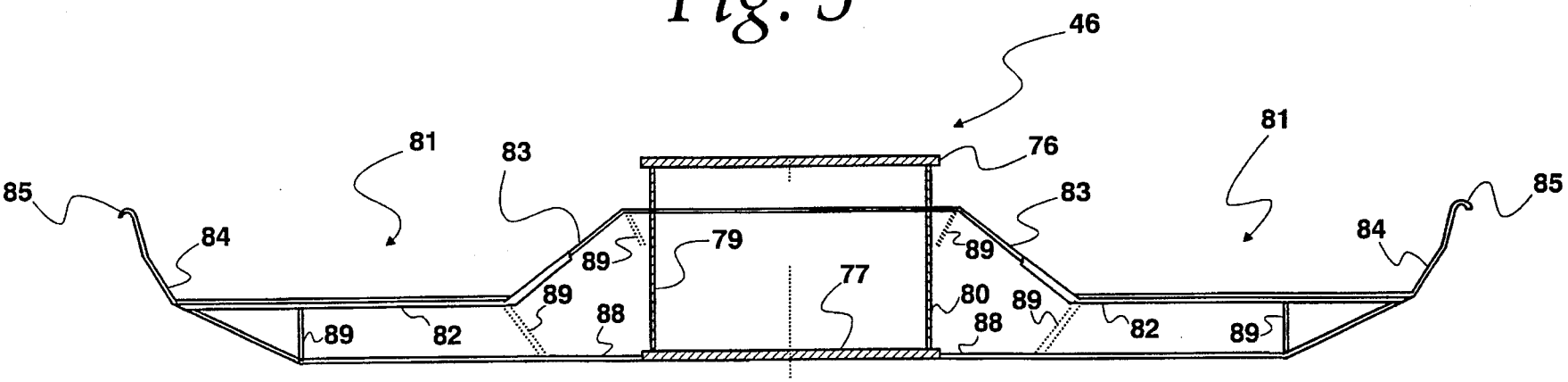
FIG. 5 is an enlarged, cross-sectional view taken through the sill to show the depression at which the trailer wheels are supported.

As best seen in FIG. 5, the sill 46 is shown as having a box-shaped configuration for the car unit spine with a pair of parallel horizontal plates 76 and 77 joined at their lateral edges to the upper and lower ends of a pair of parallel vertical plates 79 and 80. The trailer wheels 31 rest on the top of horizontal wheel support platforms 81 comprising a flat, horizontal bottom plate 82 and a pair of reversely inclined, inner and outer walls 83 and 84 which pinch the trailer wheels to hold the same against lateral sliding across the bottom plate 82. The outer inclined walls have rolled turn flanges 85 at their free edges. The wheel support platform also includes an underlying support structure of an underlying web 88 and suitable braces 89 extending from the underlying web 88 to the bottom plate 82 and the inclined walls 83 and 84. The wheel supporting platform extends long enough in the longitudinal direction of the car unit to support three trailer wheels and extends only the length of the sill depression 45. The upper front sill portion 48 and the upper rear sill portion 49 will have the same spine or sill construction, as shown in FIG. 5, without the wheel supporting platforms and at a higher elevation, with the lower plate 77 of the sill above a supporting truck.

In order to maximize the load carrying capacity, that is, the volume being carried per train length, the present invention has the number of car units at an even number and has the car units symmetrical about the center line 50 through the central shared truck 17, as shown in FIG. 1, which results in the two-adjacent interior car units 13 and 14 having trailers being disposed back to back with the depressions 45 of the car units 13 and 14 being closely adjacent one another. With this back to back positioning of trailers 30 and of their respective car units 13 and 14, the forward one-half of the articulated car has the trailers 30 thereon facing forwardly; whereas, the rear one-half of the car has the trailers 30 thereon facing rearwardly, as shown in FIG. 1. In contrast thereto, FIG. 2 of the conventional spine car shows all of the car units facing forwardly and in the same direction. Of course, there is no symmetrical center pivot articulation member between car units when there are five car units or any odd number of car units, rather than an even number of car units as in the present invention. Typical spine cars have odd number of car units, e.g., 3 or 5 car units.

In accordance with another aspect of the invention, and to distribute the load better with respect to the shared truck axles, the hitches 33 for the interior car units 13 and 14 preferably project to a location over an adjacent end 52 of an end car unit 11 and 12. It is this shifting of the trailer hitch load onto the shared trucks 16 and 18 that results in the better and more equal distribution of the weight from the trailers 30 onto the shared truck axles 41 and 42. This is in contrast to the usual position for the trailer hitch which is shown just rearwardly of the shared trucks in conventional spine car of FIG. 2.

In accordance with another aspect of this invention, the trailer hitch support structure 60 is made adjustable so that the hitch 33 itself may be located at the center line 62, which indicates the forwardmost position for the hitch for the longest trailer. For an intermediate length truck, the adjustable support structure 60 will be positioned to locate the hitch 33 at the center line 63. For the shortest length of trailer, the support structure is shifted rearwardly to locate the hitch at the center line 64. The position of the respective hitch center lines 62, 63 and 64 are determined by the length of the trailers. It is preferred to use the positions 62 and 63 for most trailers to keep the loads shifted forwardly and over the shared trucks 16, 17 and 18, as shown in FIG. 1.

Another important aspect of the present invention is that it is able to carry a number of trailers with a relatively shorter train length because the trailers are placed more closely together with the trailer hitches for the first and last car units being at the limit necessary to allow clearance only with other coupled cars and with the interior trailers hitches projecting over the shared trucks of the interior car units. This reduction in the length of the car is particularly important when one considers that the railroad sidings often have a very limited length as to the number of cars that can be placed on the siding to allow another train to move along the same track parallel to the siding. Thus, it is thought that as much as more freight can be hauled per car length when using the articulated car 10 than that of a train of conventional well cars each having only a single trailer or having one container therein.

Turning now to another embodiment of the invention as shown in FIG. 4, there is a plan view showing the center beam 46 which is provided with a pair of forward projecting support arms 70 and 71 for holding container ends. The container ends may be provided with the typical pedestal locking devices 73 at four corner locations so as to hold the container and lock the containers onto the spine car 10. Additionally, conventional side arms (not shown) may be extended outward from the beam 46 to keep the containers from rolling over and off the spine car unit. It is contemplated that the pedestal and locking devices 73 for the containers may be movable between inoperative lowered position where they are not in use, and are not needed, where the trailer kingpin is secured to and locked in a hitch and the wheels of the trailer are resting in the supports at the bottom of the depressions. On the other hand, when the container is used, rather than the trailers, the weight may be supported out of the four corners of the container in the conventional manner with the usual pedestal supports and with the usual locks to grip and hold the four corners of the container.

What is claimed is:

1. A railroad car for carrying container or trailer loads comprising:

a forward end car unit and a rearward end car unit;

an end truck located at the front end of the forward car unit and an end truck located at the rear end of the rearward car unit;

a plurality of interior car units adjacently disposed between the forward and rearward car units;

a plurality of shared trucks;

articulated connectors on the shared trucks for joining the car units to adjacent interior car units and adjacent end car units; and a hitch support structure for a kingpin on one of the car units, the hitch support structure extending over the center of one of the trucks which supports the car unit.

2. A train in accordance with claim 1 further comprising a sill on each car unit, each sill having an upper end portion carried by the trucks which support the car unit and a lowered intermediate portion to create a depression to permit the wheels to be supported at a lower level to reduce the overall height of the train to facilitate passage through tunnels.

3. A railroad car in accordance with claim 1 wherein the hitch support structure on a car unit is adjustable to receive a trailer kingpin at different positions depending on the length of the trailer.

4. A railroad car in accordance with claim 1 wherein the hitch support structure projects from its associated car unit over the truck supporting the car unit which is less proximate to the center of the car.

5. A railroad car in accordance with claim 1 further comprising a pair of support arms projecting outwardly and longitudinally to positions beyond the shared truck axles toward an adjacent car unit, and pedestals on the support arms to support ends of the containers at locations over an adjacent car unit.

6. A railroad car for carrying trailers having kingpins and wheels comprising:

a forward car unit having a forward twin axle truck;

a rearward car unit having a rear twin axle truck;

an even number of interior car units adjacently disposed between the forward and rearward car units;

shared trucks between the forward car unit and one of the interior car units and between the rearward car unit and another of the interior car units;

articulated connectors between the car units with a central connector being located at a substantially central location along the length of the car;

a sill on each car unit, the sill having a lowered intermediate portion offset from the center of the car unit toward the central connector to permit the wheels to be supported such that trailers on the car units closest to the central connector are disposed back to back; and a hitch for kingpins on each of the car units with the hitch of the forward units being located at or forward of a forward axle of the forward truck on the forward car unit and the hitch of rearward car unit being located at or rearward of the rear axle of its associated rearward truck.

7. A railroad car in accordance with claim 6 wherein the car units are symmetrical about the central connector with one-half of the depressions offset toward the front of the car units, and the other half of the depressions offset toward the rear of the car units, such that all of the depressions are offset toward the central connector.

8. A railroad car for carrying trailers comprising:

a forward end car unit having a forward twin axle end truck;

a rearward end car unit having a rear twin axle end truck;

a plurality of interior car units adjacently disposed between the forward and rearward car units;

a plurality of shared trucks;

articulated connectors on the shared trucks for joining the car units to adjacent car units;

oppositely disposed trailers on two adjacent interior car units; and a trailer on one of the end car units extending beyond the center of the end truck associated with the end car unit.

* * * * *